US009211731B2

(12) United States Patent
Maeda

(10) Patent No.: US 9,211,731 B2
(45) Date of Patent: Dec. 15, 2015

(54) PRINT CONTROL DEVICE, PRINT CONTROL METHOD, AND STORAGE MEDIUM

(71) Applicant: CANON KABUSHIKI KAISHA, Tokyo (JP)

(72) Inventor: Masao Maeda, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/315,870

(22) Filed: Jun. 26, 2014

(65) Prior Publication Data

US 2015/0002572 A1 Jan. 1, 2015

(30) Foreign Application Priority Data

Jun. 28, 2013 (JP) ..... 2013-137055

(51) Int. Cl.
*B41J 29/38* (2006.01)
*B41J 29/393* (2006.01)
*B41J 11/00* (2006.01)

(52) U.S. Cl.
CPC ..... *B41J 11/008* (2013.01); *B41J 11/003* (2013.01)

(58) Field of Classification Search
USPC ..... 347/16, 19
See application file for complete search history.

(56) References Cited

U.S. PATENT DOCUMENTS

2006/0044334 A1* 3/2006 Fujita et al. ..... 347/12
2006/0192804 A1* 8/2006 Nakata et al. ..... 347/16
2013/0235109 A1* 9/2013 Nakamaki ..... 347/16
2014/0078205 A1* 3/2014 Hayashi ..... 347/16

FOREIGN PATENT DOCUMENTS

JP 11-155043 A 6/1999

* cited by examiner

*Primary Examiner* — Jason Uhlenhake
(74) *Attorney, Agent, or Firm* — Canon USA, Inc. I.P. Division

(57) ABSTRACT

In a case that a setting size for a print medium is set in print target data and the setting size has not been acquired as a candidate, a size having an aspect ratio corresponding to the aspect ratio of the setting size is specified. Next, a printer is controlled to print an image based on the print target data having a size corresponding to the size.

17 Claims, 9 Drawing Sheets

FIG. 4A

| | | | |
|---|---|---|---|
| PAPER SIZE | PAPER WIDTH | PAPER LENGTH | ASPECT RATIO |
| L SIZE | 89.0 | 127.0 | 1.43 |
| WESTERN-STYLE ENVELOPE NO. 6 | 98.0 | 190.0 | 1.94 |
| POSTCARD | 100.0 | 148.0 | 1.48 |
| DUODECIMO SIZE | 101.6 | 152.4 | 1.50 |
| ELONGATED ENVELOPE NO. 3 | 120.0 | 235.0 | 1.96 |
| 2L SIZE | 127.0 | 178.0 | 1.40 |
| RETURN POSTCARD | 200.0 | 148.0 | 0.74 |
| SIXTH | 203.2 | 254.0 | 1.25 |
| A4 | 210.0 | 297.0 | 1.41 |
| LETTER | 215.9 | 279.4 | 1.29 |
| 300 | 301 | 302 | 303 |

FIG. 4B

| | | | | CANDIDATE PAPER SIZE CLOSE TO REAL SIZE | | | | | | | | | |
|---|---|---|---|---|---|---|---|---|---|---|---|---|---|
| PAPER SIZE | PAPER WIDTH | PAPER LENGTH | ASPECT RATIO | L SIZE | WESTERN-STYLE ENVELOPE NO. 6 | POSTCARD | DUODECIMO SIZE | ELONGATED ENVELOPE NO. 3 | 2L SIZE | RETURN POSTCARD | SIXTH | A4 | LETTER |
| L SIZE | 89.0 | 127.0 | 1.43 | - | | | | | | | | | |
| WESTERN-STYLE ENVELOPE NO. 6 | 98.0 | 190.0 | 1.94 | | - | × | × | | | | | | |
| POSTCARD | 100.0 | 148.0 | 1.48 | | × | - | × | | | | | | |
| DUODECIMO SIZE | 101.6 | 152.4 | 1.50 | | × | × | - | | | | | | |
| ELONGATED ENVELOPE NO. 3 | 120.0 | 235.0 | 1.96 | | | | | - | | | | | |
| 2L SIZE | 127.0 | 178.0 | 1.40 | | | | | | - | | | | |
| RETURN POSTCARD | 200.0 | 148.0 | 0.74 | | | | | | | - | × | × | × |
| SIXTH | 203.2 | 254.0 | 1.25 | | | | | | | × | - | × | × |
| A4 | 210.0 | 297.0 | 1.41 | | | | | | | × | × | - | × |
| LETTER | 215.9 | 279.4 | 1.29 | | | | | | | × | × | × | - |
| 300 | 301 | 302 | 303 | 304 | | | | | | | | | |

PRINT CONTROL DEVICE, PRINT CONTROL METHOD, AND STORAGE MEDIUM

BACKGROUND OF THE INVENTION

1. Field of the Invention

The present invention relates to a print control device, a print control method, and a storage medium, which print an image based on printing target data.

2. Description of the Related Art

There has been a technology in which, when printing is executed at a printer, a paper width sensor included in the printer detects the width of a print sheet used at the printer, and a printing target image is enlarged or reduced in accordance with the width of the sheet detected by the paper width sensor.

Japanese Patent Laid-Open No. 11-155043 discloses technology in which the width of a print sheet is detected by a sensor, and print data is enlarged or reduced in accordance with the detected sheet width to perform printing, as technology which eliminates necessity to perform paper size selection operations by the user.

However, in a case of the method disclosed in Japanese Patent Laid-Open No. 11-155043, a printing target image is enlarged or reduced with the width of a print sheet detected by the sensor as a reference, and the longitudinal direction of the print sheet is not considered, so printing according to the length of the print sheet cannot be performed.

Also, for example, in a case that a width different from the widths of print sheets set in the printer has been detected due to detection error of the width of a print sheet by a sensor, this may prevent suitable printing from being performed. Specifically, there may be a case where another sheet size having a sheet width similar to the widths of print sheets set in a printer is identified as the size of the print sheets set in the printer due to detection error by the sensor. In a case that the length of a size thus erroneously identified is greatly different from the print sheets set in the printer, suitable printing may not be able to be performed.

SUMMARY OF THE INVENTION

It has been found to be desirable to provide a print control device, a print control method, and a storage medium, which enable a suitable image to be printed.

Further features of the present invention will become apparent from the following description of exemplary embodiments with reference to the attached drawings.

BRIEF DESCRIPTION OF THE DRAWINGS

FIGS. 4A and 4B are diagrams illustrating a paper size table in the present embodiment.

DESCRIPTION OF THE EMBODIMENTS

Hereinafter, an embodiment of the present invention will be described in detail.

First Embodiment

Figure 1:
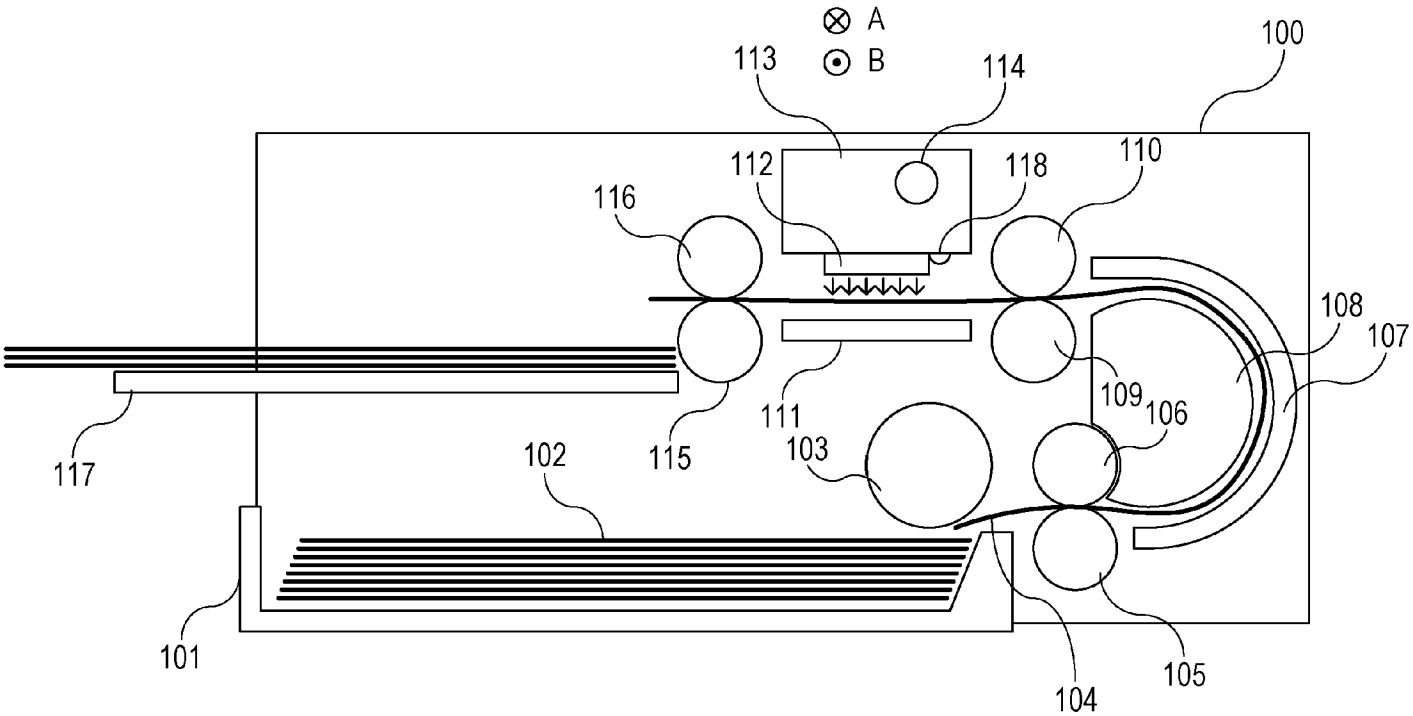
FIG. 1 is a diagram illustrating a printing mechanism which a printer includes.

FIG. 1 is a diagram illustrating a printing mechanism which a printer 100 according to the present embodiment includes. A paper feeding tray 101 stores print sheets. A paper feeding roller 103 feeds the print sheets stored in the paper feeding tray 101 to conveyance rollers 105 and 106. A print sheet 104 is a print sheet which is fed by the paper feeding roller 103 and conveyed by the conveyance rollers 105 and 106. As illustrated in FIG. 1, the print sheet 104 passes through a conveyance path made up of the conveyance rollers 105 and 106, and members 107 and 108, and is conveyed to conveyance rollers 109 and 110. The conveyance rollers 109 and 110 convey the print sheet 104 to a platen 111.

Also, a carriage 113 on which a printing head 112 is mounted is provided above the platen 111. The carriage 113 performs reciprocal scanning in A direction (direction from front to depth in FIG. 1) and B direction (direction from depth to front in FIG. 1) illustrated in FIG. 1 along a guide rail 114. The printer 100 applies a driving pulse to the printing head 112 while causing the carriage 113 to perform scanning in the A and B directions, thereby ejecting a recording material such as ink or the like from the printing head 112. Thus, the recording material is ejected from the printing head 112 to the print sheet 104, whereby a printing target image is printed on the print sheet 104. The print sheet 104 on which the image has been printed is further conveyed to paper ejection rollers 115 and 116 by the conveyance rollers 109 and 110. The paper ejection rollers 115 and 116 discharge the print sheet 104 to a paper ejection tray 117.

Also, a paper sensor 118 which is a reflection type optical sensor is provided to the carriage 113. The printer 100 acquires an output level (output voltage) indicating the intensity of light which the paper sensor 118 receives, and determines whether or not the output level thereof is a level corresponding to reflected light from a print sheet, whereby detection can be made regarding whether or not there is a print sheet in a position where this light has been received. Also, as described above, the paper sensor 118 is provided to the carriage 113, and is scanned along with the printing head 112. The printer 100 detects whether or not there is the print sheet 104 in a range where scanning of the paper sensor 118 is performed, whereby end portions of the print sheet 104 in this scanning range can be determined. Also, the width of this print sheet 104 can be detected based on distance between the left and right end portions of this print sheet 104. Details of this detection processing will be described with reference to FIG. 2. The scanning position of the paper sensor 118 (carriage 113) is detected by a later-described encoder 224.

The printer 100 includes the above-described paper feeding tray 101, platen 111, printing head 112, carriage 113, guide rail 114, paper ejection tray 117, and the above various rollers as a printing mechanism.

Figure 2:
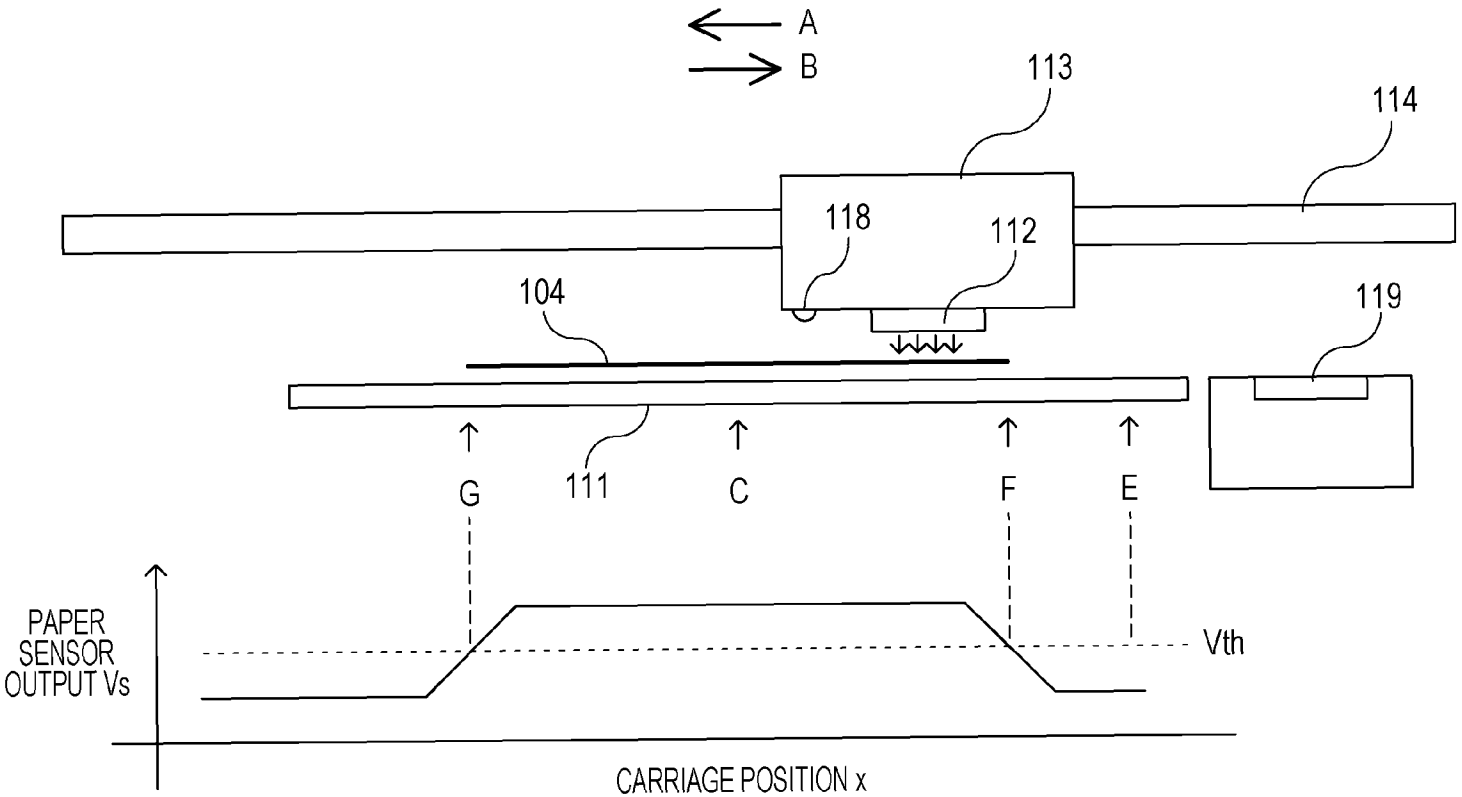
FIG. 2 is a diagram for describing detection of paper width by a paper sensor.

FIG. 2 is a diagram for describing detection of a paper width by the paper sensor 118.

As described above, the printer 100 causes the printing head 112 to eject the recording material while reciprocally moving the carriage 113 in the arrow A and B directions along the guide rail 114, thereby printing an image on the print sheet 104. Also, a head recovery mechanism 119 configured to perform capping of the printing head 112 is provided in a position separated from the platen 111 in a range of movement (a position x of the paper sensor 118) of the carriage 113. The position x of the paper sensor 118 is identified by the position of the carriage 113 detected by a later-described encoder 224.

Also, the paper sensor 118 receives light while performing scanning on the platen 111, and detects the output level of the received light. The graph illustrated in FIG. 2 illustrates output levels that the paper sensor 118 detected in the range of movement of the carriage 113. Note that a print sheet has a bright color such as white or the like, and the platen 111 has a dark color such as black or the like in the present embodiment. Accordingly, a high output level (strong reflected light from the print sheet) is obtained regarding a position where a print sheet exists on the platen 111, and a low output level (weak reflected light from the platen 111) is obtained regarding a position where a print sheet does not exist.

The paper sensor 118 receives reflected light in a position E on the platen 111 when the carriage 113 is in the position of the head recovery mechanism 119. Upon the carriage 113 moving toward the A direction, the output levels in positions corresponding to the end portions of the print sheet 104 increase. A generally constant output level is obtained from an end portion of the print sheet 104 to the end portion on the opposite side, and the output level decreases in the end portions.

In a case that the output level of the paper sensor 118 exceeds a predetermined threshold VT, it is determined in the present embodiment that the print sheet 104 exists in a position where this output level has been detected. Specifically, let us say that positions G and F in FIG. 2 are the positions of the ends of the print sheet 104, and a range from the position G to position F is a range where the print sheet 104 exists. Also, distance from the position G to position F is detected as the sheet width of the print sheet 104.

Note that the printer 100 conveys the print sheet 104 in a centered manner so that the center of the print sheet 104 is at the center position C on the platen 111 in the present embodiment. At this time, if the print sheet 104 is great, and the right end of the print sheet 104 is positioned closer to the right side than a position E in FIG. 2, the position of the right end of the print sheet 104 may not be able to be detected.

Therefore, in a case that the right end of the print sheet 104 is positioned closer to the right side than the position E, the printer 100 determines the sheet width of the print sheet 104 based on distance between the center position C and the position G of the left end of the print sheet 104 in the present embodiment. Specifically, first, in a case that the output level in the position E exceeds VT, the printer 100 determines that the position of the right end of the print sheet 104 is the position E or closer to the right side than the position E. When such a determination is made, length obtained by doubling distance between the center position C and position G is detected as the sheet width of the print sheet 104. Specifically, since the printer 100 conveys the print sheet 104 so that the center of the print sheet 104 becomes the center position C, distance between the center position C and the position G of the left end of the print sheet 104 becomes half length of the sheet width. Accordingly, the printer 100 can detect length obtained by doubling the distance between the center position C and position G as the sheet width. Note that a value indicating the center position C in the scanning range of the carriage 113 is stored in memory within the printer 100 beforehand, and the printer 100 can obtain the distance between the center position C and position G with reference to this value.

Note that the above threshold VT may be other than a fixed value, or may be changed according to the output level in the position E, for example. Also, the threshold VT may be determined according to the intensity of reflected light due to the surface characteristic of a print medium. Specifically, the threshold VT is changed according to the type of paper (ordinary paper, glossy paper, or the like) used for printing. Further, presence/absence of a print sheet may be determined from a comparison result between the output level in the position E and the output level in another position instead of a method for determining whether or not the output level exceeds the threshold as described above. For example, in a case that determination is made that there is no print sheet in the position E according to the output level in the position E, determination may be made that a print sheet exists in a position having an output level greater than that output level by a predetermined value or more.

Also, though description has been made in the method in FIG. 2 regarding an example in which the paper sensor 118 is provided to the carriage 113, and detection is performed while the paper sensor 118 is moving, the present embodiment is not restricted to this. For example, a paper sensor may be provided above the platen 111 separately from the carriage 113. In this case, paper sensors of which the number corresponds to the width of a conveyance path of a print sheet are arrayed, and the width of the print sheet can be determined by determining whether or not each paper sensor has detected existence of the paper sheet.

Figure 3:
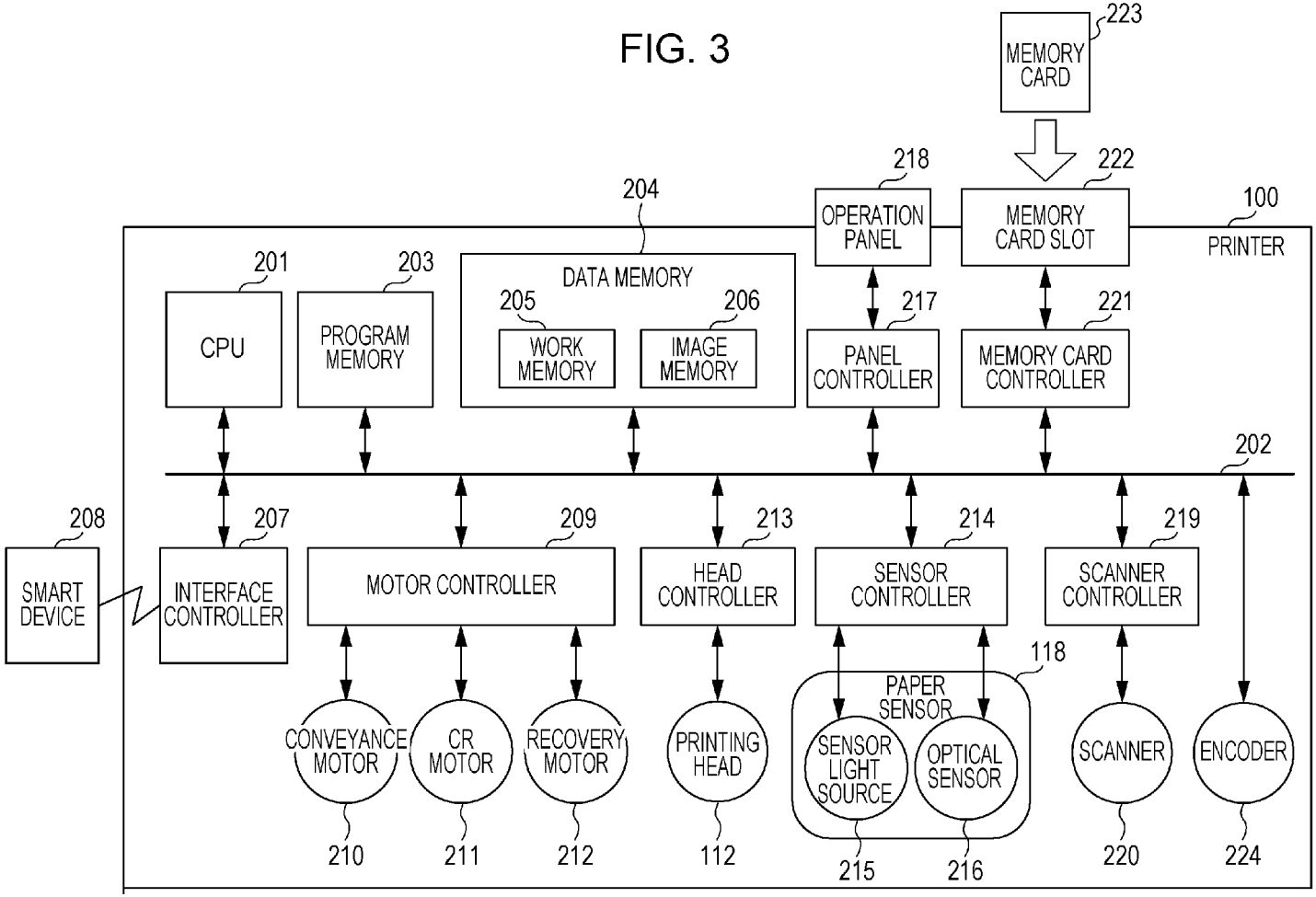
FIG. 3 is a block diagram illustrating a configuration of the printer.

Next, the configuration of the printer 100 will be described. FIG. 3 is a block diagram illustrating the configuration of the printer 100.

A central processing unit (CPU) 201 is a processor configured to control the printer 100. The CPU 201 is connected with program memory 203, such as read only memory (ROM), a hard disk, or the like, and data memory 204, such as random access memory (RAM) or the like, via an internal bus 202. The program memory 203 stores a program configured to control the printer 100. The CPU 201 reads out a program stored in the program memory 203 to the data memory 204, and executes the program on work memory 205 allocated to the data memory 204, whereby the printer 100 can be controlled. Also, image memory 206 is also allocated to the data memory 204, and various types of data, such as image data that is printed at the printer 100, are loaded to the image memory 206 by the CPU 201.

An interface controller 207 performs communication with a smart device 208, such as, a smartphone, tablet, cellular phone, or the like, via an interface under the control of the CPU 201. For example, the interface controller 207 can receive a printing target job from the smart device 208, and notify status information of the printer 100 to the smart device 208. Note that the interface controller 207 may perform communication via a cable interface such as a Universal Serial Bus (USB) cable or the like, or may perform communication via a wireless interface, such as infrared communication, wireless LAN, or the like.

Also, a communication partner is not restricted to the smart device 208, and may be a personal computer. In addition, the communication partner may be a server connected to the printer 100 via a network, or may be a device, such as a facsimile, digital television, or the like connected to the printer 100 via a telephone line. Also, the present embodiment is not restricted to a case where printing target data is included in a print job, and the printer 100 may acquire printing target data from an external device such as a server or the like in accordance with address information included in a print job.

A motor controller 209 controls various motors configured to drive the printing mechanism of the printer 100 under the control of the CPU 201. A conveyance motor 210 drives the paper feeding roller 103, conveyance rollers 105, 106, 109, and 110, and paper ejection rollers 115 and 116 illustrated in FIG. 1, under control of the motor controller 209. A carriage motor 211 (CR motor) drives the carriage 113 in accordance with the control of the motor controller 209 to reciprocally move the carriage 113. Also, a recovery motor 212 drives the head recovery mechanism 119 in accordance with the control of the motor controller 209.

A head controller 213 controls the printing head 112 in accordance with the control of the CPU 201 to cause the printing head 112 to eject a recording material, such as ink or the like. The CPU 201 drives the printing head 112 and conveyance motor 210 together, thereby printing an image on a print sheet while scanning the printing head 112. Specifically, the CPU 201 within the printer 100 operates as a print control device, and controls the various motors and printing head 112 serving as a printing mechanism to print an image.

A sensor controller 214 controls a sensor light source 215 included in the paper sensor 118 to emit light, and also controls the optical sensor 216 which the paper sensor 118 includes to receive reflected light in accordance with the control of the CPU 201. Also, the sensor controller 214 acquires an output level indicating the intensity of light which the optical sensor 216 has received. The CPU 201 acquires the output level that the sensor controller 214 has acquired, whereby determination of the paper width illustrated in FIG. 2 can be performed. Note that the CPU 201 executes later-described processing, thereby determining the paper size including paper length according to the paper width determined as described above.

A panel controller 217 controls an operation panel 218 in accordance with the control of the CPU 201. Note that the operation panel 218 includes operation devices, such as keys, a touch panel, and so forth, which the user operates, and a display panel capable of displaying various types of information, such as an image and so forth. For example, upon the user operating an operation device of the operation panel 218, the user's instruction is input to the panel controller 217, and the instruction thereof is further input to the CPU 201. Also, in response to the instruction from the CPU 201, the panel controller 217 displays an image loaded in the image memory 206 on the display panel of the operation panel 218.

A scanner controller 219 controls a scanner 220 to scan original document loaded on an original document plate of the scanner 220, and to input a scanned image thereof in accordance with the control of the CPU 201. Also, the scanner controller 219 stores the scanned image in the image memory 206. A memory card controller 221 performs writing or read-out of various types of data on a memory card 223 mounted on a memory card slot 222 under the control of the CPU 201.

An encoder 224 identifies the position of the carriage 113 when the carriage 113 performs scanning along the guide rail 114. The CPU 201 identifies the position x of the paper sensor 118 illustrated in FIG. 2 based on the position of the carriage 113 identified by the encoder 224, and the attachment position of the paper sensor 118 in the carriage 113.

The CPU 201 determines the paper size including paper length according to the paper width determined by the paper sensor 118 as described above in the present embodiment. Note that the paper sensor 118 is provided to the carriage 113 along with the printing head 112 in the printer 100 according to the present embodiment. Members, such as various motors and guide rail 114 configured to move the carriage 113, the encoder 224 configured to identify the position of the carriage 113, and so forth, are commonly used for both of printing by the printing head 112 and detection of a paper width by the paper sensor 118. Therefore, the above members do not have to be provided for detection of a paper width separately from members for printing, so increase in the size of the printer 100 can be suppressed.

FIGS. 4A and 4B are diagrams illustrating a paper size table according to the present embodiment. The paper size management table in FIG. 4A includes a paper size 300 used at the printer 100, and the power width 301 and paper length 302 and aspect ratio 303 of this size. Note that the paper width 301 and paper length 302 are expressed in units of millimeters (mm).

Note that, since the paper size table is stored in the program memory 203, the CPU 201 can reference the paper size table by reading out this from the program memory 203 to the data memory 204. Note that the way in which the information of the paper width 301 is held is not restricted to holding in a table format, and various methods for storing the paper width 301 in a manner associated with paper size may be employed.

The CPU 201 determines the size of a print sheet according to the paper width detected by the paper sensor 118 in the present embodiment. Specifically, the CPU 201 identifies the paper size 300 having a paper width 301 included in a predetermined range of the paper width detected by the paper sensor 118 in the paper size table as the size of the print sheet 104 conveyed in the printer 100. The reason why the predetermined range is thus provided, is because error may occur between the detection result of the paper sensor 118 and the actual paper width since the intensity of reflected light from a print sheet differs depending on the state of the print sheet and the environment where the printer 100 is installed, for example.

Therefore, for example, in a case that the predetermined range has been set to ±3 mm, and 126.0 mm has been detected as the paper width by the paper sensor 118, the CPU 201 identifies the paper sizes 300 corresponding to the paper widths 301 included in 123.0 mm to 129.0 mm as candidates of the size of the print sheet. As illustrated in the paper size table in FIG. 4A, 2 L size corresponding to the paper width 301 (127.0 mm) is identified as a candidate in this case.

Also, identification of a paper size is not restricted to a case where the paper size is uniquely identified, and multiple paper sizes of which the paper widths are close may be identified as candidates of the size of this print medium. For example, in a case that 99.0 mm has been detected as the paper width by the paper sensor 118, western-style envelope No. 6 (paper width: 98.0 mm), postcard (paper width: 100.0 mm), and duodecimo size (paper width: 101.6 mm) are included in a paper width range of 96.0 mm to 102.0 mm. Similarly, in a case that 213.0 mm has been detected as the paper width, A4 size (paper width: 210.0 mm) and letter (paper width: 215.9 mm) are identified as candidates of the paper size.

The size of a printing target image is determined, as described above, in accordance with the candidates of the size of a print sheet based on the detection by the paper sensor 118, and the setting size of the print sheet set as a print setting in the present embodiment. Specifically, in a case that a candidate size of the print sheet is similar to the aspect ratio of the setting size, an image having a size according to this candidate is printed.

Examples of this include a case where the user sets the setting size of a print sheet in the print setting while intending a printing application (photography printing, envelope printing, etc.), and a case where the size is automatically set as a suitable print setting for a printing application. In this case, a printing application to which this print setting has been set can be estimated by referencing the setting size in the print setting. For example, in a case that the L size has been set as a set paper size, estimation can be made that the printing target data is a photograph, and the printing application is photography printing.

Also, the user may set, for a particular printing application, a print sheet according to the application thereof in the printer. Even if the size of print sheets set in the printer, and the setting size of the print sheet differ, both may be sizes frequently used for a common printing application. Specifically, for example, in a case that the setting size is the L size that is frequently set in photography printing, there is a high likelihood that the 2 L size or duodecimo size other than the elongated envelope No. 3 which is frequently set in an envelope printing application is set in the printer.

Also, for example, in a case that the setting size is a size that is frequently set in photography printing, such as the L size or the like, the aspect ratio of this size is similar to that of a size that is frequently set in photography printing in the same way as the L size, such as the 2 L size, duodecimo size, or the like, in comparison with a size that is frequently set in an envelope printing application, such as the elongated envelope No. 3, or the like. On the other hand, the aspect ratio of the elongated envelope No. 3 is a greater aspect ratio than that of the paper size for photography printing, and is similar to the aspect ratio of a paper size that is frequently set in envelope printing in the same way as the western-style envelope No. 6 or the like.

Accordingly, there is a high likelihood that a candidate of which the aspect ratio is similar to the aspect ratio of the set paper size is the size of a print sheet which has been set in the printer, and this candidate is an even more suitable candidate for a printing application in this printing.

As described above, there is printed an image having a size according to a candidate of which the aspect ratio is similar to the setting size in the present embodiment. Therefore, there can be printed an image having a size according to the size of a print sheet which is more likely to have been set in the printer.

Note that the above print setting is set according to the user's instruction at a host computer or smart device which is a device configured to transmit a print job to the printer 100. Specifically, a display screen for the user instructing setting relating to the size of a print sheet, the type of the print sheet, and a margin provided to the print sheet at the time of printing being performed is displayed by the host computer or smart device. For example, the user instructs print setting on the display screen after selecting printing target data, whereby print setting as to printing of this printing target data can be instructed. Thus, print setting information indicating the print setting instructed by the user is transmitted to the printer 100 from the host computer or smart device along with the printing target data. Note that the print setting information may be transmitted to the printer 100 as a print job including the print setting information and the printing target data, or each of the printing target data and print setting information may individually be transmitted. For example, the print setting information including the set paper size may also be transmitted to the printer 100 as one file separately from a file including the printing target data, such as a Digital Print Order format (DOFF) file.

Note that, as described with reference to FIG. 2, there is a possibility in the present embodiment that one end of the print sheet 104 is not detected by the sheet sensor 118 in a case that the print sheet 104 is great, the paper width is determined by computation based on distance between the center position C and position G at this time. In this case, for example, the print sheet 104 may be conveyed with the center deviated from the center position C, due to the characteristics of the print sheet 104 and so forth. Accordingly, in a case that one end of the print sheet 104 has not been detected, the predetermined range may be set relatively wider, for example, such as ±10 mm or the like, instead of ±3 mm. In this case, for example, if 210 mm has been detected as the paper width, there are identified return postcard (paper width: 200.0 mm), sixth (paper width: 203.2 mm), A4 size (paper width: 210.0 mm), and letter (paper width: 215.9 mm) as candidates of the paper size.

Also, in the above example, there have been identified the paper sizes included in a predetermined range (e.g., ±3 mm) with the paper width which is the detection result of the paper sensor 118 as the center. However, the present embodiment is not restricted to this, and paper sizes included in a greater range than the detection result by a predetermined width (e.g., ±3 mm) may be identified, or conversely, paper sizes included in a smaller range by a predetermined width may be identified. Also, the predetermined range may be changed according to the type (ordinary paper, glossy paper, etc.) of a print sheet. For example, in a case that the print sheet is glossy paper, reflected light is strong in comparison with ordinary paper. At this time, there is a possibility that the output level that the paper sensor 118 has obtained in a position, which is originally not the position of the print sheet, exceeds the threshold VT, and determination is made that the print sheet is in this position. Accordingly, for example, an arrangement may be made in which in a case that the type of the print sheet is ordinary paper, the range of ±3 mm is set, and in a case of glossy paper, the range of −6 mm is set. In addition, the predetermined range may be set according to various conditions such as identification of the paper sensor 118, and so forth.

Also, though determination of the paper size has been performed using the paper size table illustrated in FIG. 4A in the above description, the paper size table in FIG. 4B may be employed as another example.

The paper size table in FIG. 4B includes, in addition to the paper size table in FIG. 4A, paper information 304 indicating paper having a similar paper width. Specifically, a paper size indicated by a symbol (x) in the table has a paper width similar to that of the paper size corresponding to this paper size in the table. For example, the A4 size and letter size are specified to have a similar paper width in the table. Also, the western-style envelope No. 6, postcard, and the duodecimo size are specified to have a similar paper width.

The CPU 201 can reference the paper width 301 by reading out the paper size table in FIG. 4B from the program memory 203 to the data memory 204. Upon a paper width being detected by the paper sensor 118, the CPU 201 identifies the paper size corresponding to the detected paper width. In a case that paper sizes having a paper width similar to that of this paper size are specified in the paper size table, the CPU 201 identifies multiple candidates of paper sizes including the paper sizes having a similar paper width.

For example, in a case that the paper width detected by the paper sensor 118 is 90.0 mm, the L size is uniquely identified as the paper size. On the other hand, in a case that the paper width detected by the paper sensor 118 is 99.0 mm, the postcard size which is the most similar to this detected paper width is identified as the paper size, and in addition to the postcard size, the western-style envelope No. 6 and duodecimo size are specified in the paper information 304 are identified.

As described above, the CPU 201 identifies the paper size of a print sheet including not only the paper width 301 but also the paper length 302 based on the paper size table in FIG. 4A or FIG. 4B. Next, the CPU 201 executes print processing according to the identified paper size.

Note that the CPU 201 can perform printing by setting an optional paper size as the paper size as well as the paper size (regular sheet size) illustrated in FIG. 4. Specifically, the CPU 201 sets the paper width and paper length in increments of millimeters (mm) as the paper size, and enlarges or reduces the printing target image according to the set paper width and paper length, whereby an image having a size corresponding to the set paper size can be printed on a print sheet.

Figure 5:
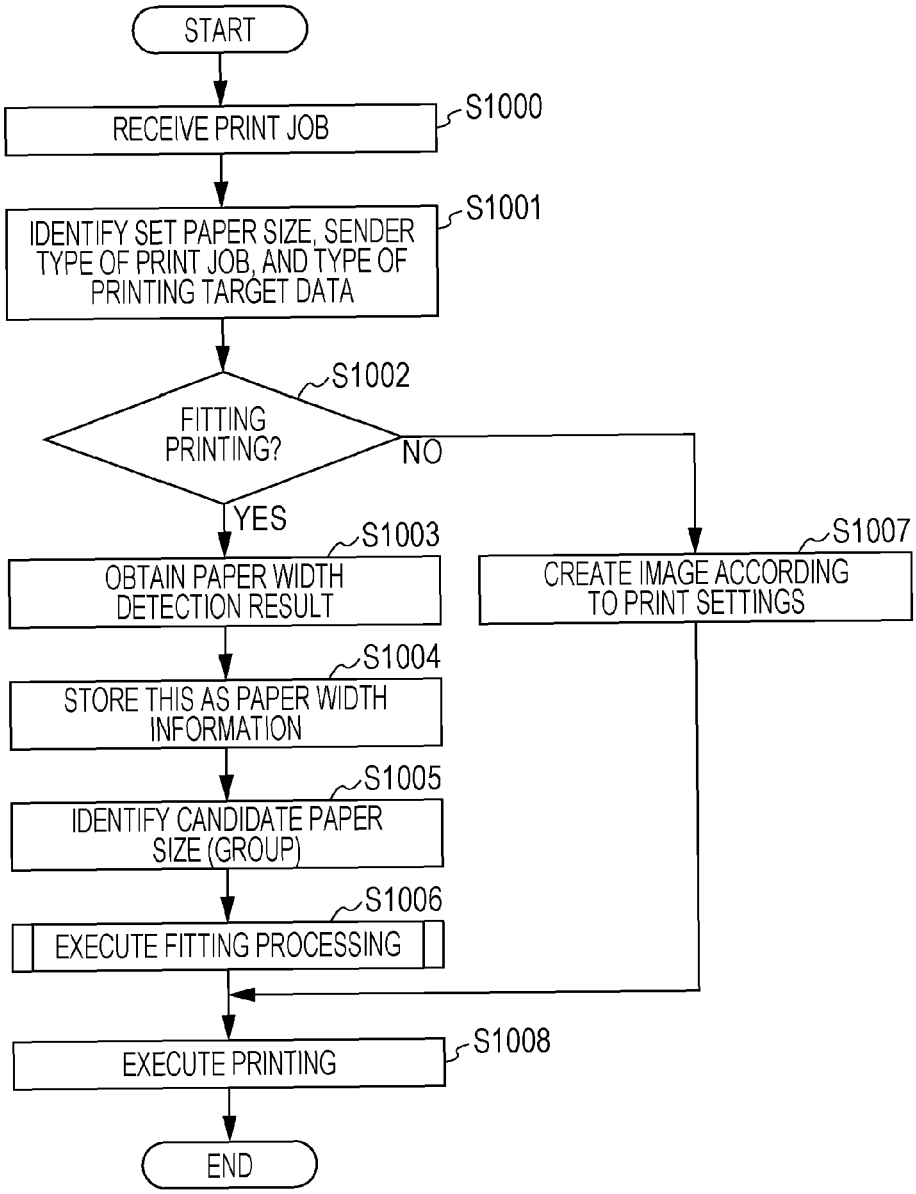
FIG. 5 is a flowchart illustrating an example of print control processing by a CPU.

FIG. 5 is a flowchart illustrating an example of print control processing by the CPU 201. Note that a program corresponding to the processing of the flowchart illustrated in FIG. 5 is stored in the program memory 203. The CPU 201 reads out this program to the work memory 205, and executes this on the work memory 205, whereby the processing in the steps in the flowchart illustrated in FIG. 5 can be realized.

In S1000, the CPU 201 receives a print job from an external device via the interface controller 207, and stores this in the data memory 204. Note that this print job includes data such as an image serving as a printing target in the printer 100, and so forth, and print setting information indicating print settings of the type and size of a print sheet in printing of this data.

Upon receiving the print job in S1000, in S1001 the CPU 201 identifies the paper size set in the print settings, the type of a device which transmitted this print job, and the type of printing target data included in this print job.

Note that, in S1001, the CPU 201 analyzes the print setting information included in the print job received in S1000. Next, the CPU 201 identifies the setting size (set paper size) of a print sheet set in the print target data corresponding to this print job within the print setting information thereof. This set paper size within the print setting information is set by a device (server, host computer, smart device, etc.) which transmitted the print job received in S1000. For example, upon a user of this device specifying the size of a print sheet on a screen of this device, size information indicating the size thereof is registered in the print setting information as the set paper size, and a print job including this print setting information is received in S1000. In S1001, the size of a print sheet thus set is identified, for example.

Note that the print setting information is included in a print job as information apart from the printing target data within the print job. Specifically, information indicating the set paper size is also included apart from the printing target data. Also, the print setting information including the set paper size may be transmitted to the printer 100 as one file, such as a Digital Print Order Format (DOFF) file. That is to say, the print setting information may be transmitted to the printer 100 as a file apart from the printing target data (JPEG file or the like).

Also, the present embodiment is not restricted to a case where the user specifies the set paper size, and the set paper size may be set in the print target data beforehand. For example, a paper size at the time of printing this photography image may be described in the header portion of a photographic image file of the printing target data. Also, in a case that data specifying a page size, such as a Portable Document Format (PDF) file or the like, is a printing target, this page size may be identified as the set paper size in S1001.

However, depending on the device which has transmitted the print job received in S1000, or the application that has performed a print instruction in this print job, there are cases where the print setting information includes the setting information of the size of a print sheet, and where the print setting information does not include the setting information thereof. In S1001, in a case that the print setting information includes the setting information of the size of a print sheet, the CPU 201 identifies the size that this setting information indicates is as the set paper size.

Also, in a case of identifying the type of the device, for example, the CPU 201 may identify the type using a protocol in communication at the time of receiving the print job from an external device, or may receive information indicating the type of the external device from the external device to identify the type based on this information. Also, the CPU 201 may identify the type of the printing target data by confirming the extension of the printing target file, or may perform identification processing based on the information thereof after the printer 100 receives information indicating the type of the printing target data from the device which transmitted the print job.

In S1002, the CPU 201 determines whether to execute fitting printing in which printing is performed by fitting the size of the printing target image to the size of a print sheet stored in the printer 100, according to the device type identified in S1001, and the type of the printing target data. Specifically, the CPU 210 identifies whether or not the device type and data type identified in S1001 are predetermined types respectively, and in a case of the predetermined types, determines to execute the fitting printing. For example, in a case that the printer 100 can receive a print job from the server, host computer, or smart device 208, the CPU 201 executes the fitting printing with the smart device 208 as the predetermined device type. Also, the CPU 201 confirms the file format of the printing target data to determine whether or not the file format is a predetermined file format. In a case of a device or file format which is likely for a photograph to be selected as a printing target is set as the predetermined type, for example, so fitting printing can be executed regarding the photograph in a surer manner.

Let us say that file formats that can be printed at the printer 100 include the JPEG format, a predetermined raster file format, and PDF. The predetermined type of file format is, for example, the JPEG format or predetermined raster format. In S1002, the CPU 201 determines to execute fitting printing in a case that the file format identified in S1001 is a predetermined file format. On the other hand, in a case that the file format identified in S1001 is PDF, the CPU 201 determines not to execute fitting printing.

Note that, though determination is made in S1002 based on both of the device type and the type of the printing target data whether to execute fitting printing, determination processing may be performed based on either one of the types. For example, an image imaged by an imaging apparatus may be stored in memory using the JPEG format as the file format. Therefore, in S1002, the CPU 201 may perform determination processing to execute fitting printing in a case that the printing target data has the JPEG format.

Also, information identified in S1001 serving as a condition of determination in S1002 may be various types of information. For example, in a case that the print mode of the printer 100 is a mode to perform fitting printing, the CPU 201 may perform fitting printing. Further, in a case that the printer 100 includes multiple interfaces, the CPU 201 may determine whether to perform fitting printing using the interface used at the time of reception of the print job in S1000. Also, in a case that "actual size printing" is specified in the print setting information, the CPU 201 does not have to perform fitting printing.

Also, fitting printing may be performed, as another condition, in a case that no paper size is specified in the print setting information included in the print job received in S1000. Examples of a case where no paper size is specified include a case where information indicating paper size is not included in the print setting information, and a case where information for instructing fitting printing is included in the print setting information as the information of paper size.

Further, determination may be made, as yet another condition, whether to perform fitting printing according to whether or not the user has been specified on the screen that fitting printing is performed depending on detection of the paper width by the paper sensor 118. For example, an arrangement may be made in which the CPU 201 of the printer 100 displays a screen including a check box which allows the user to perform the instruction on the operation panel 218, and in a case that the user has entered a check in this check box, performs fitting printing. In addition, an arrangement may be made in which the above screen is displayed at an external device configured to transmit print job data to the printer 100, and the user instructs fitting printing at the external device thereof. In this case, the external device includes (adds) information to allow the user to perform fitting printing in (to) the print job data, and transmits this to the printer 100. In S1002, the CPU 201 of the printer 100 determines whether to perform fitting printing depending on whether or not the above information has been received from the external device. Note that the above screen displayed on the operation panel 218 or external device is displayed before printing, and the contents that the user has specified before printing are confirmed at the time of execution of printing in S1002, whereby whether to perform fitting printing is determined. Also, in addition, an arrangement may be made in which the above screen is displayed at the time of execution of printing, and the user performs an instruction at the time of execution of printing.

Further, in a case that the above instruction by the user for performing fitting printing has not been received, in S1002 the CPU 201 may determine not to perform fitting printing regardless of the device type and printing target data type identified in S1001. That is to say, in a case that the above instruction by the user has been received, and also the device type and printing target data type are predetermined types, the CPU 201 may determine to perform fitting printing.

In a case that determination is made in S1002 that fitting printing is executed, the CPU 201 executes processing in S1003 to S1006. On the other hand, in a case that determination is made that fitting printing is not executed, the CPU 201 proceeds to S1007.

In S1003, the CPU 201 causes the motor controller 209 sensor controller 214 to drive the carriage 113 and paper sensor 118 to execute paper width detection described with reference to FIG. 2. In the next S1004, the CPU 201 acquires the paper width detected by the paper width detection in S1003, and stores this in the work memory 205 as paper width information.

Next, in S1005 the CPU 201 specifies one or multiple paper sizes from the regular sheet sizes that the printer 100 handles as candidates of the size of a print medium with reference to the paper width information stored in S1004 and the paper size table in FIG. 4A or 4B. As described above, multiple paper sizes are extracted as candidates of the size of the print medium depending on the paper width information stored in S1004. Note that the extracted paper sizes (group) are stored in the work memory 205 as candidate paper size information.

Next, in S1006 the CPU 201 execute the fitting processing in which a printing target image is created on the image memory 206 in accordance with the size of the print medium being conveyed in the printer 100. Details of this fitting processing will be described later with reference to FIG. 6.

In a case that determination is made in S1002 that fitting printing is not executed, the CPU 201 executes the processing in S1007. In S1007, the CPU 201 creates a printing target image on the image memory 206 in accordance with the print settings specified by the print setting information. For example, in a case that printing target image data is included in the print job, and "enlargement/reduction printing" serving as a print method and "A4 size" serving as a print paper size are set in the print settings, the CPU 201 rasterizes the image data, and enlarges or reduces the rasterized image in accordance with the A4 size. Also, in a case that "actual size printing" is specified as a print method, the CPU 201 creates a printing target image without performing the enlargement/reduction processing. Note that in a case that borderless printing is specified, the printing target image is laid out in a layout region where the print paper size set in the print settings is enlarged with a borderless enlargement scale.

For example, in a case that the file format identified in S1001 is PDF, in S1002 the CPU 201 determines that fitting printing is not executed. In this case, in S1007 the CPU 201 may set a paper size according to the page size set in the PDF file.

The information of the page size can be written in the PDF file. For example, a suitable page size for pages in the PDF file is written therein. If page fitting is performed on a size other than the page size thereof, printing may be performed on a print sheet of which the size differs from the size of the print sheet to be originally printed. Therefore, in a case that the file format identified in S1001 is PDF, the CPU 201 does not perform fitting printing, and in S1007 sets the page size within the PDF file as the size of the print sheet.

Also, in a case that the printing target is a PDF file, in S1007 the CPU 201 may execute detection of a paper width by the paper sensor 118. In this case, the CPU 201 compares the width of the page size within the PDF file, and the paper width detected by the paper sensor 118. When difference between both is smaller than a predetermined width, the CPU 201 executes printing in accordance with the page size, and when the difference is equal to or greater than a predetermined width, may display an error message for allowing the user to confirm the size of the print sheet on the operation panel 218.

In S1008, the CPU 201 outputs the printing target image created on the image memory 206 in S1006 or S1007 to the head controller 213. Next, the CPU 201 activates the printing head 112 and carries 113 to print the printing target image on the print medium.

Note that, when creating the printing target image in S1006 or S1007, in a case that the printing target data is image data such as a JPEG image file or the like, the CPU 201 performs decompression processing on the printing target data to rasterize bitmap data thereof on the image memory 206. Also, in a case that the printing target data is vector data, the CPU 201 performs rendering processing at the image memory 206 to rasterize bitmap data thereof on the image memory 206.

According to the processing illustrated in the flowchart in FIG. 5 thus described, the image of the size according to the print settings or the size based on the detection result of the paper sensor 118 is printed by the printer 100.

Figure 6:
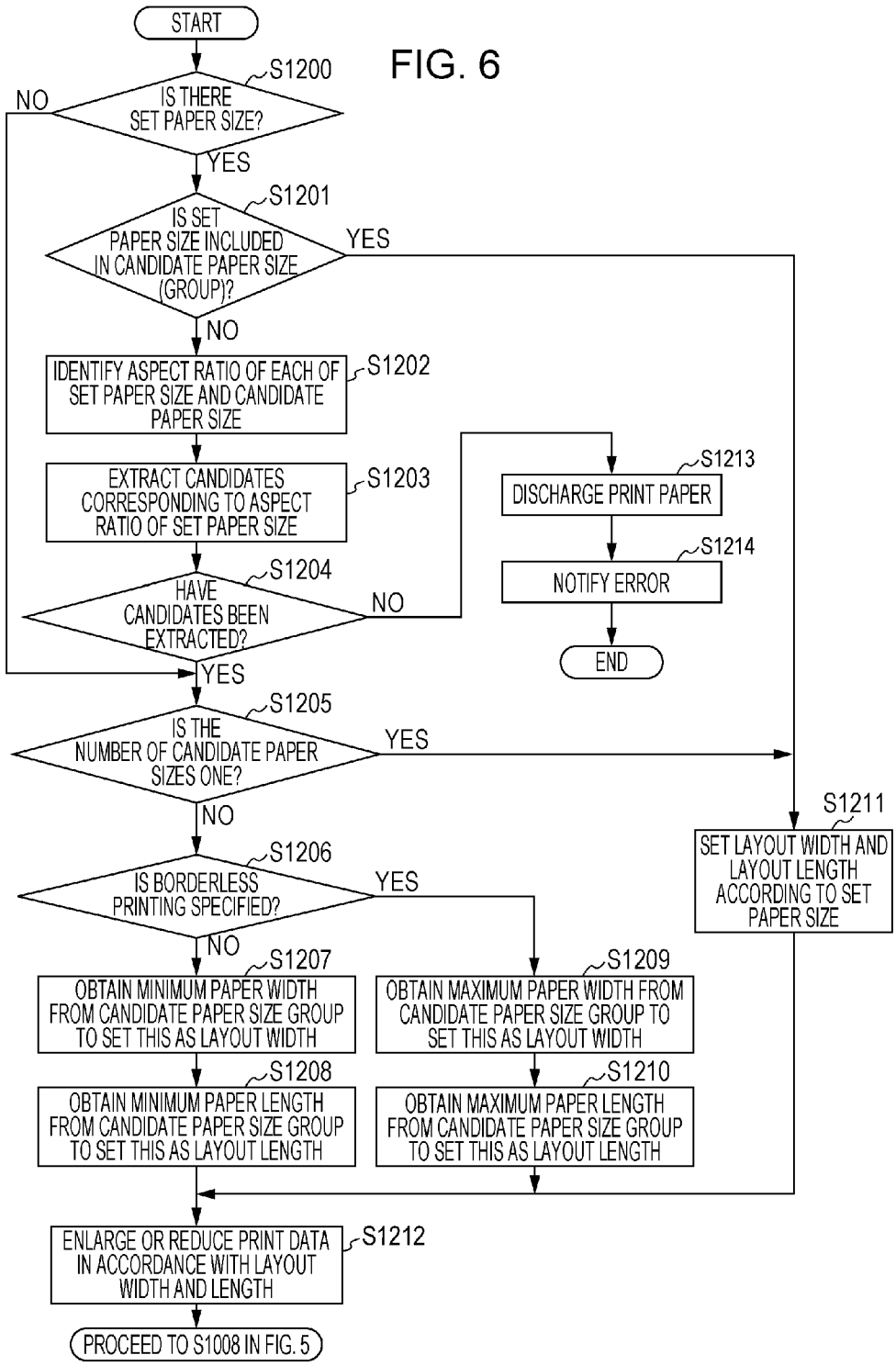
FIG. 6 is a flowchart illustrating contents of fitting processing in the flowchart in FIG. 5.

FIG. 6 is a flowchart illustrating the contents of the fitting processing in S1006 in FIG. 5.

In S1200 in FIG. 6, the CPU 201 determines whether or not the set paper size has been identified in S1001 in FIG. 5. As described in the description relating to S1001, depending on the device which has transmitted the print job or an application which has performed the print instruction, there are cases where the print setting information includes setting information indicating the size of the print sheet, and where the print setting information does not include the setting information thereof. In S1200, the CPU 201 determines that the print setting information in the print job includes the setting information indicating the size of the print sheet, and the set paper size that the setting information thereof indicates has been identified in S1001.

In a case that determination is made in S1200 that the set paper size has been identified in S1001, the CPU 201 proceeds to S1201, and in a case that determination is made that the set paper size has not been identified, proceeds to S1205. Processing in S1205 will be described later.

In S1201, the CPU 201 determines whether or not the set paper size identified in S1001 is included in the candidates (group) acquired in S1005 of the size of the print sheet based on the width of the print sheet detected by the paper sensor 118. In a case that determination is made that the set paper size is not included in the candidate paper size group, the CPU 201 proceeds to S1202. On the other hand, in a case that determination is made that the set paper size is included in the candidate paper size group acquired in S1005, the CPU 201 proceeds to S1211. Details of processing in S1211 will be described later.

In S1202, the CPU 201 identifies the aspect ratio of each of the set paper size identified in S1001 and the candidate sizes (group) identified in S1005. In a case that there are multiple candidate paper sizes (group), the CPU 201 identifies the aspect ratio of each of the candidates.

Note that the CPU 201 can identify the aspect ratios of the candidate paper sizes (group) with reference to the aspect ratio 303 in the paper size management table illustrated in FIG. 4A or 4B. For example, in a case that the candidates are "western-style envelope No. 6", "postcard", and "duodecimo size", the CPU 201 can identify aspect ratios of 1.94, 1.48, and 1.50, respectively.

Also, in a case that the set paper size is the regular sheet size, in the same way as the candidate paper sizes (group), the CPU 201 can identify the aspect ratio of the set paper size with reference to the aspect ratio 303 with the paper size management table illustrated in FIG. 4A or 4B. For example, in a case that the set paper size is "L size", the CPU 201 can identify the aspect ratio of "1.43" with reference to the paper size management table. Also, the set paper size is not restricted to the regular sheet sizes in the present embodiment, so a non-regular sheet size may be specified as the set paper size. For example, an arrangement may be made in which the user can optionally specify the width and length of the print sheet at a device which transmits the print job in increments of millimeters. Values in increments of millimeters indicating the width and length of the print sheet are set as the set paper size, and the CPU 201 identify these values in S1001. Thus, in a case that the set paper size is the non-regular sheet size, in S1202 the CPU 201 can identify the aspect ratio of the set paper size by calculating (the value of the length of the set paper size/the value of the width of the set paper size).

In S1203, the CPU 201 extracts a candidate corresponding to the aspect ratio of the set paper size identified in S1202. Specifically, the CPU 201 sets a deviation tolerance range as to the aspect ratio of the set paper size identified in S1202, and determines whether or not the aspect ratios of the candidate paper sizes (group) identified in S1202 are included in the tolerance range thereof. The CPU 201 identifies a candidate corresponding to an aspect ratio included in the tolerance range. The aspect ratio tolerance range is assumed to be ±0.1 of the aspect ratio of the set paper size in the present embodiment. For example, in a case that the set paper size is "L size (aspect ratio: 1.43)", in S1203 the CPU 201 extracts a candidate of which the aspect ratio is in a range of 1.33 to 1.53. For example, in a case that the candidates are "western-style envelope No. 6 (aspect ratio: 1.94)", "postcard (aspect ratio: 1.48)", and "duodecimo size (aspect ratio: 1.50)", the CPU 201 excludes "western-style envelope No. 6" and extract "postcard", and "duodecimo size".

In S1204, the CPU 201 determines whether or not a candidate corresponding to the aspect ratio of the set paper size has been extracted from the candidate paper sizes (group) in S1203. In a case that determination is made that a candidate has been extracted, the CPU 201 proceeds to S1205, and in a case that determination is made that no candidate has been extracted, the CPU 201 proceeds to S1213. Details of processing in S1213 will be described later.

In S1205, the CPU 201 determines whether or not the number of candidates for the print paper size acquired in S1005 is only one. In a case that determination is made in S1205 that the number of candidates for the print paper size is two or more, the CPU 201 proceeds to S1206. On the other hand, in a case that determination is made that the number of candidates for the print paper size is only one, the CPU 201 sets the candidate thereof as the size of the print sheet (set paper size), and proceeds to S1211. Processing in S1211 will be described later.

In S1206, the CPU 201 determines whether or not borderless printing is set as the margin setting in printing of the print job received in S1000. Various conditions may be employed at the time of determining whether or not borderless printing is set. For example, the CPU 201 may determine that borderless printing is set in a case that the print mode of the printer 100 is a mode to perform borderless printing. Also, the CPU 201 may determine that borderless printing is set in a case that the margin setting is input from the print setting information included in the print job received from the smart device 208 in S1001 in FIG. 5, and borderless printing is specified in the margin setting thereof. Further, the CPU 201 may receive information for identifying the device which has transmitted the print job and an application used for the print instruction along with the print job in S1001 in FIG. 5. In this case, the CPU 201 may determine that borderless printing is set, with reference to the device or application type identified by this information. The CPU 201 may determine whether or not borderless printing is set, with reference to the size or type of the print sheet used for printing. For example, the CPU 201 may determine that borderless printing is set in a case that a print sheet of which the printing target image is frequently a photograph has been set as the print settings, such as a case where the size of the print sheet is "L size" or "2 L size", or a case where the type of the print sheet is "glossy paper", or the like.

In a case that determination is made in S1206 that borderless printing is not specified, the CPU 201 proceeds to S1207. In S1207, the CPU 201 acquires the minimum paper width from the paper width of each of the multiple candidates for the size of the print sheet included in the candidate paper size group, and stores this in a predetermined region in the work memory 205 as the width (layout width) of the layout region where the printing target image is rasterized. For example, in a case that the A4 size (paper width: 210.0 mm, paper length: 297.0 mm), and letter size (paper width: 215.9 mm, paper length: 279.4 mm) are candidates, in S1207 the CPU 201 acquires the A4 size width 210.0 mm. In S1208, the CPU 201 acquires the minimum paper width from the paper width of each of the multiple candidates for the size of the print sheet included in the candidate paper size group, and stores this in a predetermined region in the work memory 205 as the layout length. In the case of the above example, the CPU 201 acquires the paper length of 279.4 mm of the letter size.

On the other hand, in a case that determination is made in S1206 that borderless printing is set, the CPU 201 proceeds to S1209. In S1209, the CPU 201 acquires the maximum paper width from the candidate paper size group, and stores this in a predetermined region in the work memory 205 as the layout width. In a case that the A4 size and letter size are candidates, the CPU 201 acquires the paper width of 215.9 mm of the latter size. Next, in S1210, the CPU 201 acquires the maximum paper length from the candidate paper size group, and stores this in the predetermined region of the work memory 205 as the length (layout length) of the layout region where the printing target image is rasterized. In the case of the above example, the CPU 201 acquires the paper length of 297.0 mm of the A4 size.

Note that the CPU 201 has acquired the maximum width and length from all candidates of the candidate paper size group in S1209 and S1210 to decide the layout width and layout length in the above description. However, a paper size regarding which borderless printing is unsupported may be included in the candidate paper size group according to the configuration of the platen 111 of the printer 100, the type of paper, and a use application. In such a case, the CPU 201 may acquire the maximum width and maximum length by limiting paper sizes to a paper size with borderless printing being handled out of the candidate paper size group in the layout decision processing in a case of borderless printing performed in S1209 and S1210.

Upon the layout width and layout length being decided in the processing from S1206 to S1210, the CPU 201 proceeds to S1212.

In S1212, the CPU 201 rasterizes the printing target image corresponding to the print job received in S1000 in FIG. 5 on the image memory 206 in the data memory 204 after enlarging or reducing the printing target image in accordance with the stored layout width and layout length.

Note that, in S1212, in a case that the printing target image is included in the print job, the CPU 201 rasterizes the image thereof on the image memory 206. Also, in a case that text data or vector data is included in the print job, or in a case that the printing target is a structured document such as an HTML file or the like, the CPU 201 performs rendering processing on the data, thereby rasterizing the printing target image on the image memory 206. Further, in a case that a URL and file path for identifying the storage location of the printing target data is included in the print job, the CPU 201 acquires the printing target data from an external server or inner memory or external memory in accordance with the information. Next, the CPU 201 rasterizes the target image on the image memory 206 based on that data.

In a case that determination is made in S1201 that the set paper size is included in the candidate paper sizes (group), or in a case that determination is made in S1205 that the number of the candidate paper sizes is only one, the CPU 201 proceeds to S1211.

In S1211, the CPU 201 decides the width (layout width) and length (layout length) of the layout region where the printing target image is rasterized, according to the width and length of the set paper size and margin setting, and stores these in a predetermined region in the work memory 205, and proceeds to S1212.

In S1212, the CPU 201 enlarges or reduces the printing target image according to the width and length of the layout region decided in S1211, and rasterizes the printing target image on the image memory 206.

In a case that the processing in S1211 has been executed through the processing in S1202 to S1205, a candidate corresponding to the aspect ratio of the set paper size is identified of the candidate paper sizes (group), and the size of the layout region is decided according to the candidate thereof. That is to say, in a case of NO in S1201 (set sheet size is not included in candidate sheet sizes), an image corresponding to the size of the aspect ratio close to the aspect ratio of the set sheet size is printed.

Also, as described above, in a case that determination is made in S1201 that the set paper size is included in the candidate paper sizes (group), in S1211 the CPU 201 decides the width and length of the layout region where the printing target is rasterized, based on the set paper size thereof.

Accordingly, for example, in a case that the user has specified a desired size as the size of a print sheet at the device which transmits a print job, the CPU 201 can rasterize an image in the layout region having a size corresponding to the size thereof, and print this image.

Also, in a case that the set paper size is not included in the candidate paper sizes (group), and also, there are multiple candidates having an aspect ratio similar to the aspect ratio of the set paper size, according to the processing in S1206 to S1210, the CPU 201 decides the width and length of the layout region according to whether or not borderless printing is set.

According to the processing in S1207 and S1208, in a case that there are multiple candidates for the size of the print sheet, and also, determination is made that borderless printing is not specified (No in S1206), the CPU 201 acquires the minimum paper width and minimum paper length of the paper width and paper length of each of the multiple candidates. Next, In S1212 the CPU 201 enlarges or reduces the printing target image in accordance with the size of the pasteurization region where the margin is removed from each of the minimum paper width and minimum paper length. Thus, even when the print sheet used at the printer 100 is any one of the multiple candidates, the CPU 201 generates the printing target image of which the width and length are shorter than the paper width and paper length of the print sheet, whereby the overall of the printing target image can be printed on the print sheet.

Also, according to the processing in S1209 and S1210, in a case that there are multiple candidates for the size of the print sheet, and also, determination is made that borderless printing is specified (Yes in S1206), the CPU 201 acquires the maximum paper width and maximum paper length of the paper width and paper length of each of the multiple candidates. Next, In S1212 the CPU 201 enlarges or reduces the printing target image in accordance with the pasteurization region where the maximum paper width and maximum paper length thereof are further enlarged by a borderless printing enlarging scale. Thus, even when the print sheet used at the printer 100 is any one of the multiple candidates, the CPU 201 generates the printing target image of which the width and length are longer than the paper width and paper length of the print sheet in accordance with instruction of borderless printing, whereby printing can be performed so as not to provide a margin to the print sheet.

In a case that determination is made in S1204 that a candidate paper size (group) having an aspect ratio similar to the aspect ratio of the set paper size has not been extracted, the CPU 201 proceeds to S1213. At this time, in order to detect the width of the print sheet by the paper sensor 118 in S1003 in FIG. 5, the print sheet used for printing is conveyed to a position below the paper sensor 118 in FIG. 1. In S1213, in order to cancel this printing (printing based on the print job received in S1000 in FIG. 5), the CPU 201 controls the conveyance motor 210 to discharge this print sheet to the paper ejection tray 117 without performing printing by the printing head 112.

Next, in S1214 the CPU 201 notifies the user of that this printing has been cancelled as an error. For example, the CPU 201 controls the panel controller 217 to display an indicator indicating that the size of the print sheet conveyed at the printer 100 differs from the set paper size on the operation panel 218. Note that, at this time, an arrangement may be made in which the CPU 201 displays one or both of the set paper size and the candidate paper sizes (group), the user corrects both or one of the set paper size and the size of the print sheet to be printed at the printer 100, whereby the user can instruct printing again. Also, an error notification method is not restricted to the indicator, and for example, a warning tone or audio informing the contents of a warning may be output from a speaker which is not illustrated.

Also, upon error notification being performed in S1214, the CPU 201 ends the processing. At this time, the CPU 201 does not proceed to S1008 in FIG. 5, so this printing is cancelled.

According to the processing in S1213 and S1214, in a case that a candidate having an aspect ratio similar to the aspect ratio of the set paper size has not been extracted (No in S1204), the printing is immediately cancelled. For example, in a case that the set paper size that the user has set greatly differs from the size of the print sheet used for printing (No in S1201), and in a case that the aspect ratio of the set paper size also greatly differs from the aspect ratio of the print sheet (No in S1204), the CPU 201 may not be able to perform suitable printing. Specifically, for example, in a case that the user has specified the set paper size in accordance with the aspect ratio of the printing target image, upon printing being performed on a print sheet having an aspect ratio greatly differing from the aspect ratio thereof, the margin of the print sheet becomes unnecessarily large. According to the processing in S1213 and S1214, printing with such an unnecessarily large margin can be suitably restricted.

Note that a method for restricting printing is not restricted to a method for cancelling printing. For example, there may be employed a method in which in a case that the CPU 201 has performed error notification in S1211 without performing sheet discharge in S1210, and the user has instructed execution of printing in response to this error notification, printing is executed. In this case, when the user instructs cancellation in response to error notification, in S1210 the CPU 201 performs sheet discharge, and the printing is cancelled.

Also, how to cancel printing is not restricted to a method for determining whether to perform cancellation by the user's instruction, so determination may be made regarding whether to perform cancellation of printing in accordance with various conditions. The type of a print sheet set in the print setting information may be employed as a condition thereof. For example, an arrangement may be made in which, in a case that the type of a print sheet is photograph paper (glossy paper, coated paper, etc.), the CPU 201 performs cancellation processing, and in a case that the type is ordinary paper, executes printing in accordance with the set paper size or candidate paper size instead of performing cancellation processing. Thus, when there is a possibility that printing is performed on a relatively expensive print sheet such as glossy paper or the like, an image having a size inappropriate for the size of the print sheet can be avoided. Also, for example, it can be conceived that before allowing the user to perform printing on an envelope, the CPU 201 allows the user to specify "western-style envelope No. 6" as the set paper size, and to execute printing on A4-size ordinary paper, and to confirm the printing result. According to the above configuration, as described above, even when the size or aspect ratios differs between the set paper size and a candidate paper size, if the paper type is ordinary paper, printing is executed, whereby the printing that the user intends to perform can be realized.

As described above, according to the processing illustrated in FIG. 6, in a case of NO in S1201 (the set paper size does not include a candidate paper size), the CPU 201 prints an image having a size according to a candidate having an aspect ratio similar to the aspect ratio of the set paper size. That is to say, the CPU 201 prints an image to be printed having an aspect ratio similar to the aspect ratio of the print sheet, and also having a size according to the size of the print sheet thereof.

For example, in a case of allowing the user to print a photographic image, the following sheets are selection candidates of the set paper size: "L size (aspect ratio: 1.43)", "postcard (aspect ratio: 1.48)", "duodecimo size (aspect ratio: 1.50)", "2 L size (aspect ratio: 1.40)", "sixth (aspect ratio: 1.25)", and "A4 (aspect ratio: 1.41)".

Thus, we can understand that the selection candidates of a print sheet used for a photographic image have a different size but have a similar aspect ratio. For example, in a case of images photographed by a photographic device, such as a digital camera, smart device, or the like, the images have a similar aspect ratio, such as 4:3, 3:2, 16:9, or the like, so print sheets to be used at the time of printing the images also have a similar aspect ratio.

Thus, the aspect ratios of print sheets used for a photographic image have a generally similar aspect ratio. On the other hand, "western-style envelope No. 6 (aspect ratio: 1.94)" and "elongated envelope No. 3 (aspect ratio: 1.96)", which are not frequently used for photography printing, have an aspect ratio significantly different from the selection candidates for photograph printing.

Accordingly, it can be conceived that, of the candidate paper sizes (group), a candidate having an aspect ratio similar to the aspect ratio of the set paper size is a more suitable candidate for the type of the printing target data. For example, in a case that the set paper size is "L size", "2 L size" used for a photograph printing application may frequently be suitable than "elongated envelope No. 3" that is not frequently employed for a photograph printing application.

Also, the aspect ratios of print sheets used for a photograph printing application such as described above are similar, and the CPU 201 extracts a candidate having an aspect ratio similar to the aspect ratio of the set paper size in S1203 in FIG. 6, whereby a suitable candidate along the user's printing application (e.g., photograph printing) can be selected.

For example, there can be conceived a case where though the user has set a 2 L-size print sheet to the printer 100 to print a photograph, the user has erroneously specified the L size as the set paper size. In a case that "elongated envelope No. 3" and "2 L size" have become candidates for the candidate paper size, the aspect ratio of a print sheet (2 L size) is similar to the aspect ratio of the set paper size (L size), so the CPU 201 prints an image having a suitable size according to the 2 L-size print sheet thereof.

If the elongated envelope No. 3 has been selected as a candidate, regardless of the user intending to perform photograph printing, the CPU 201 performs printing in accordance with a print sheet unlikely to be set in the printer 100, which is not frequently used for photograph printing. According to S1203 in FIG. 6, the CPU 201 can exclude the elongated envelope No. 3, and suitably extract the 2 L size supporting photograph printing which is a printing application with reference to the aspect ratios of the set paper size and candidate paper sizes (group).

Note that an example has been described above in which the CPU 201 identifies the set paper size set in the print target data in S1001, and in the processing in FIG. 6, performs processing using the set paper size thereof.

However, the present embodiment is not restricted to the set paper size, so the CPU 201 may perform the processing using the aspect ratio of the printing target image instead of the set paper size. For example, in a case where an image to be printed is included in a print job received in S1000, in S1202 the CPU 201 identifies the aspect ratio of the printing target image thereof. For example, the CPU 201 counts the number of pixels in each of the longitudinal and lateral directions of the printing target image, and computes (the number of pixels in the longitudinal direction/the number of pixels in the lateral direction), whereby the aspect ratio of the printing target image can be identified. Also, in a case that the printing target is a file with a header portion where the number of longitudinal pixels and the number of lateral pixels of the image are described, such as a JPEG file or the like, the CPU 201 may identify the aspect ratio of the image with reference to the numbers of pixels described in the header portion.

Thus, upon the aspect ratio of the printing target image being identified in S1202, the CPU 201 decides the size of the layout region according to a candidate having an aspect ratio similar to the aspect ratio of the printing target image of the candidate papers sizes (group) using the processing in S1203 to S1205 and S1211. Next, the CPU 201 rasterizes this printing target image on the layout region of which the size has been decided as above, and executes printing.

As described above, the photographic image photographed by a digital camera or smart device has an aspect ratio similar to the aspect ratio of a print sheet frequently used for printing of photographic images. Accordingly, in a case that the printing target is a photographic image, and "elongated envelope No. 3" that is not frequently used for a photograph printing application and "2 L size" that is frequently used for a photograph printing application are candidates, the CPU 201 can suitably extract "2 L size" using the processing in S1203.

Also, an example has been described regarding the processing in S1203 in FIG. 6 in which the CPU 201 extracts a candidate having an aspect ratio within the tolerance range as to the aspect ratio of the set paper size. However, the present embodiment is not restricted to a case where the tolerance range is provided, so the CPU 201 may uniquely identify, of the candidate paper sizes (group), a candidate having an aspect ratio most similar to the aspect ratio of the set paper size.

Figure 7A:
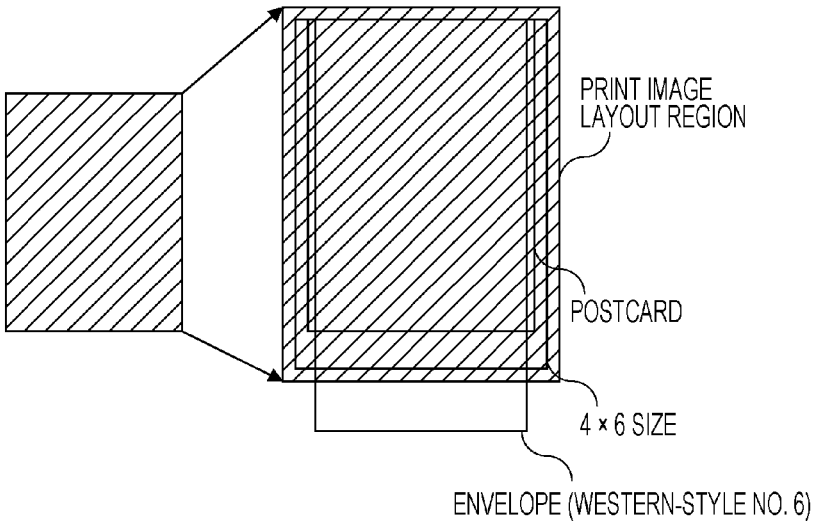
FIGS. 7A and 7B are diagrams illustrating a layout region determined by the present embodiment.
Figure 7B:
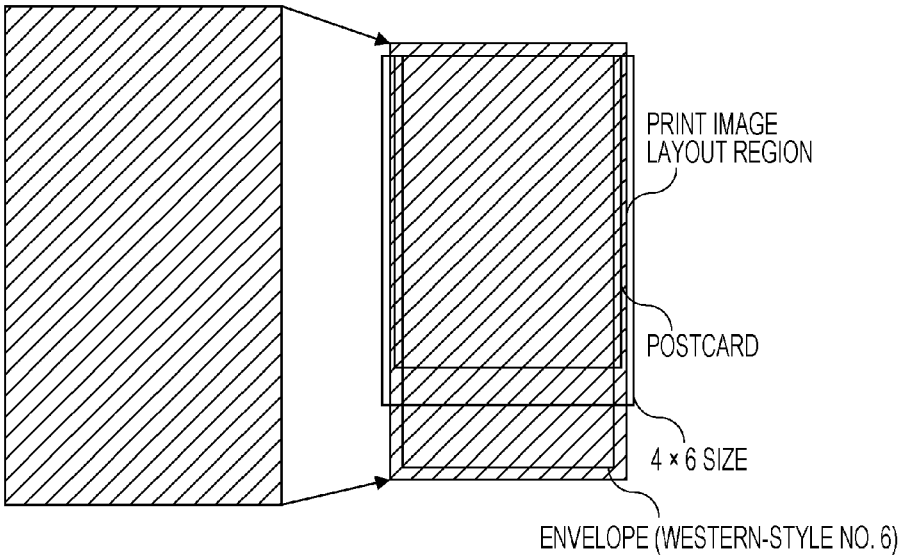

FIGS. 7A and 7B are diagrams illustrating the layout region decided by the present embodiment.

FIG. 7A illustrates an example of the layout region in a case that "L size" is specified as the set paper size, and three sizes of "postcard", "duodecimo size", and "western-style envelope No. 6" have been identified as the candidate paper size (group). Now, let us say that borderless printing is specified at this time.

At this time, if "western-style envelope No. 6", "postcard", and "duodecimo size" are considered as candidate paper sizes, in order to execute borderless printing in a sure manner, the CPU 201 has to set the layout region of which the layout length is longer than the length of the western-style envelope No. 6. However, the set paper size is the L size, so there is a high likelihood that the printing application is photograph printing, and also there is a high likelihood that the size of the print sheet set to the printer 100 supports photograph printing. Regardless of this, in a case that the layout region including the longitudinal direction of the western-style envelope No. 6 has been set, when the sizes of print sheets set to the printer 100 are "postcard" and "duodecimo size", an unnecessarily great part of the image overruns the edge, and a great part of the photographic image is missing.

Therefore, according to the processing in FIG. 6, the CPU 201 extracts "postcard" and "duodecimo size" that have an aspect ratio similar to the aspect ratio of "L size" and are frequently set in photograph printing as candidates, and excludes "western-style envelope No. 6" from candidates.

As described above, in a case that "L size" that is frequently used for a photograph printing application is specified as the set paper size, it can be conceived that at least "postcard" and "duodecimo size" are more suitable than "western-style envelope No. 6" that is not frequently used for a photograph printing application. According to the processing in FIG. 6, the CPU 201 selects a candidate suitable for a printing application corresponding to the set paper size according to the aspect ratios of the set paper size and candidate paper sizes.

At this time, since borderless printing is specified, according to the processing in S1206, S1209, and S1210, the CPU 201 decides the layout region greater than both of "postcard" and "duodecimo size" that support a printing application, and are likely to be the size of a print sheet set to the printer 100.

As illustrated in FIG. 7A, there is set the layout region including both of the candidates (postcard, duodecimo size) supporting a printing application (photograph printing) corresponding to the set paper size. Accordingly, borderless printing can suitably be executed on a print sheet set to the printer 100. For example, in a case that though the user has intended to perform borderless printing, the user has erroneously specified "L size" different from the print sheet, the CPU 201 can perform printing on the print sheet having a size according to a print sheet used for printing without providing a margin outside the printing target image.

FIG. 7B illustrates an example of the layout region in a case that the set paper size is "elongated envelope No. 3", and three sizes of "postcard", "duodecimo size", and "western-style envelope No. 6" have been identified as the candidate paper sizes (group). Now, let us say that borderless printing is specified at this time.

At this time, if "western-style envelope No. 6", "postcard", and "duodecimo size" are considered as candidate paper sizes, in order to execute borderless printing in a sure manner, the CPU 201 has to set the layout region of which the layout width is wider than the width of the duodecimo size. However, the set paper size is the elongated envelope No. 3, so there is a high likelihood that the printing application is envelope printing, and also there is a high likelihood that the size of a print sheet set to the printer 100 supports envelope printing. Regardless of this, in a case that the layout region of which the layout width is wider than the width of "duodecimo size" has been set, when the sizes of print sheets set to the printer 100 are "western-style envelope No. 6", the amount unnecessarily overrunning the sides increases, and part of the photographic image is missing.

The aspect ratios of the set paper size and candidate paper sizes are taken into consideration in the present embodiment. At this time, the set paper size is "elongated envelope No. 3 (aspect ratio: 1.98)", so the printing application can be regarded as envelope printing. Also, the envelopes have a greater aspect ratio than the aspect ratios of "postcard (aspect ratio: 1.48)" and "duodecimo size (aspect ratio: 1.50)". In S1204, the CPU 201 excludes, of the three candidates, "postcard" and "duodecimo size", and extracts "western-style envelope No. 6" as a candidate. Accordingly, the CPU 201 selects "western-style envelope No. 6" which is a candidate suitable for envelope printing serving as a printing application.

In this case, the candidates are narrowed down to one in S1204, and the CPU 201 sets the layout region according to the candidate thereof in S1211. Also, borderless printing is specified here, so the CPU 201 sets the layout region having a greater size than that of the western-style envelope No. 6.

For example, in a case that though the user has intended to perform envelope printing of the "western-style envelope No. 6", the user has erroneously specified "elongated envelope No. 3", the CPU 201 can print an image having a suitable size according to the western-style envelope No. 6 used for printing.

As described with reference to FIGS. 6, 7A, and 7B, according to the present embodiment, the CPU 201 can extract a candidate according to the printing application corresponding to the set paper size, and print an image having a size according to the extracted candidate.

Note that description has been made regarding an example in which when the printer 100 receives a print job from an external device, the CPU 201 determines the paper size of the print sheet, and executes printing according to the determined paper size. However, the present embodiment is not restricted to this, and the CPU 201 may perform determination of the paper size in a copy function to print a scanned image read by the scanner 220 which the printer 100 includes on the print sheet.

Also, though the print job from the smart device 208 connected to the printer 100 via the interface has been described in the above embodiment, there may be printing from a remote location connected to the printer 100 by a telephone lone or network line. Though the device configured to issue a print job has been described as the smart device 208, there may be employed a device, such as a cellular phone, host computer, digital television, or the like, instead of the smart device 208. Also, there may be a mode to directly receive a print job from a device which the user operates, or a mode to receive a print job via an intermediate device such as a print server or cloud service or the like.

Figure 8:
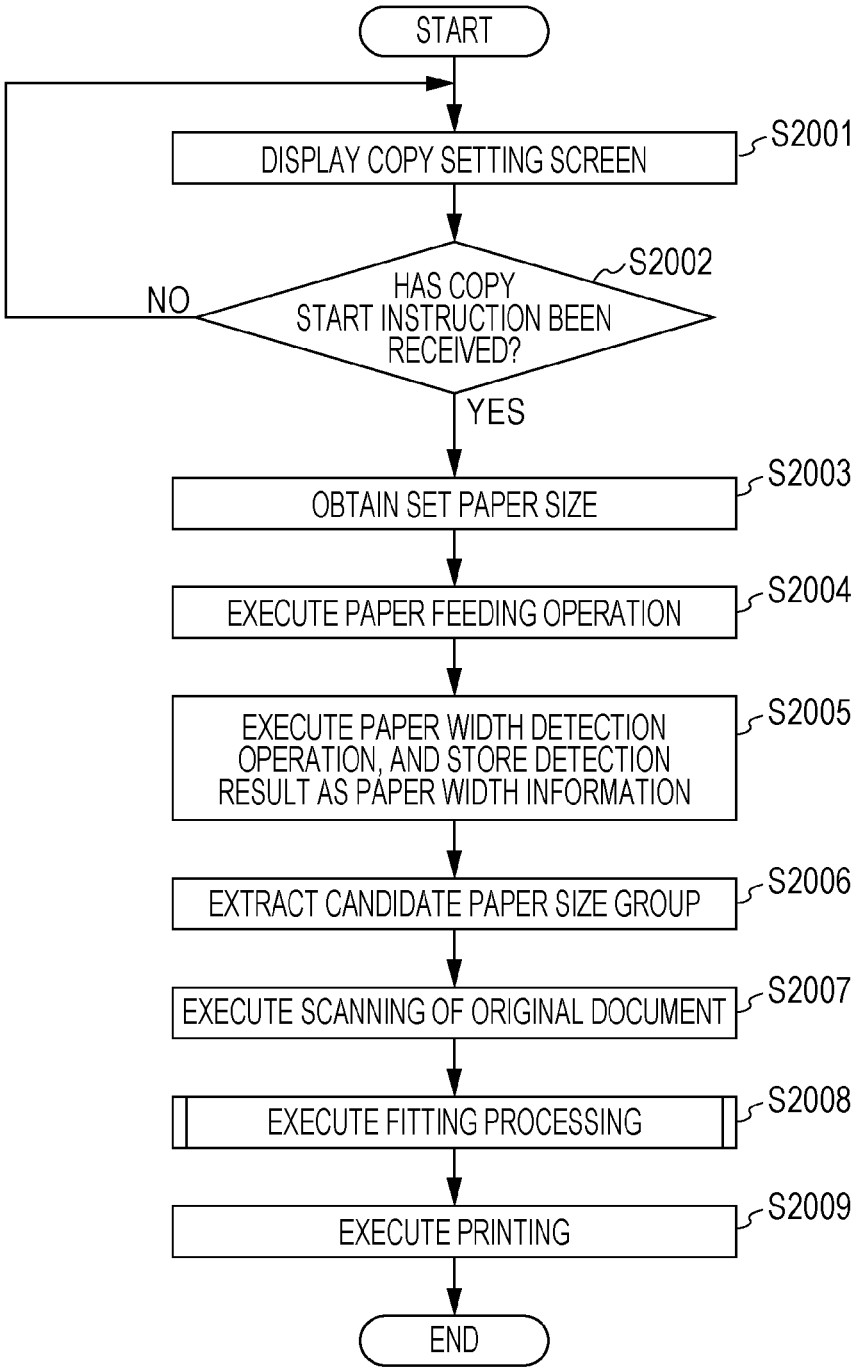
FIG. 8 is a flowchart illustrating an example of print control processing in a copy function.

FIG. 8 is a flowchart illustrating an example of print control processing in the copy function. The processing in the flowchart illustrated in FIG. 8 is, in the same way as the processing illustrated in FIG. 5, executed by the CPU 201. Also, the CPU 201 executes the processing in the flowchart in FIG. 8 when the user selects the copy function using the operation panel 218 of the printer 100, and a copy function execution instruction is input to the CPU 201.

In S2000, the CPU 201 causes the panel controller 217 to display a setting screen which allows the user to specify start of copy and setting of copy in the copy function, on the display panel of the operation panel 218. Contents set from the copy setting screen include the paper size, number of prints, margin settings, printing density, and so forth of print sheets printed in the printing function. The margin settings include a specification of "borderless copy" indicating whether to provide a margin to the print sheets, and a setting for a margin width when borderless copy is not specified. Note that copy setting information indicating copy settings which are default settings is stored in the program memory 203. The CPU 201 reads out the copy setting information to the data memory 204, and displays the default settings on the copy setting screen. The user can instruct copy settings by modifying the default settings thereof.

The above settings for copy include an enlargement/reduction setting relating to enlargement/reduction (enlarging or reduction) of a scanned image scanned by the scanner 220. For example, "actual size printing" has been specified, the CPU 201 prints the scanned image without enlarging/reducing the scanned image. Also, in a case that enlargement specification has been performed by the user, the CPU 201 enlarges/reduces the scanned image using the specified enlargement thereof. Further, in a case that "automatic enlargement/reduction" has been specified, the CPU 201 executes enlargement/reduction (fitting processing) in accordance with the size of paper stored in the printer 100.

In S2001, the CPU 201 determines whether or not the user has specified setting of copy as to the operation panel 218. In a case that the determination is made that setting of copy has been specified, the CPU 201 proceeds to S2002, and in a case that the determination is made that setting of copy has not been specified, the CPU 201 proceeds to S2003.

In S2002, the CPU 201 acquires the copy setting information indicating the setting of copy that the use has specified as to the operation panel 218, via the panel controller 217. In S2002, the CPU 201 rewrites the copy setting information stored in the data memory 204 with the copy setting information specified from the user. In S2003, the CPU 201 determines whether or not the start of copy has been specified by the user. In a case that determination is made in S2003 that a start of copy instruction has been specified, the CPU 201 proceeds to S2004, and in a case that determination is made that a start of copy instruction has not been specified, the CPU 201 returns to S2001. In S2004, the CPU 201 causes the scanner 220 to scan original document via the scanner controller 219.

Next, in S2005 the CPU 201 determines whether or not "automatic enlargement/reduction" has been specified in the copy setting information stored in the data memory 204. In a case that determination is made in S2005 that "automatic enlargement/reduction" has not been specified, in S2006 the CPU 201 creates the printing target image on the image memory 206 in accordance with the enlargement/reduction setting in the copy setting information.

On the other hand, in a case that determination is made in S2005 that "automatic enlargement/reduction" has been specified, the CPU 201 executes processing in S2007 to S2010. In S2007 to S2010, the CPU 201 identifies the size of the print sheet being conveyed in the printer 100, and enlarges/reduces the scanned image acquired by scanning in S2004 according to the identified paper size. The processing in S2007 to S2010 is the same as the processing in S1003 to S1006 described above with reference to FIG. 5, so detailed description will be omitted.

In S2011, the CPU 201 outputs the printing target image created on the image memory 206 in S2006 or S2010 described above to the head controller 213. Next, the CPU 201 drives the printing head 112 and carriage 113 to print this printing target image on the print medium.

In the above processing illustrated in FIG. 8, in a case that the enlargement/reduction setting in the copy setting information is "automatic enlargement/reduction", the CPU 201 can print an image having a size according to the paper size being conveyed at the printer 100, which has been determined based on the paper sensor 118.

According to the above embodiment, the CPU 201 extracts the paper size having an aspect ratio similar to the aspect ratio of the set paper size, based on the paper width detected by the paper sensor 118, as a candidate size of the print sheet used for printing. Thus, the CPU 201 can identify a candidate suitable for the original printing application (photograph printing, envelope printing, etc.) with reference to the aspect ratio of the set paper size. Accordingly, even when the set paper size differs from the size of the print sheet set in the printer 100, the CPU 201 can print an image having a size according to the size of the print sheet which is likely to be set in the printer 100.

Note that the CPU 201 has been described as comparing the aspect ratios of the set paper size and candidate paper sizes, thereby identifying a candidate having an aspect ratio similar to the aspect ratio of the set paper size in the above embodiment. However, the present embodiment is not restricted to this, so information (e.g., table) in which the paper setting size is associated with a paper size having an aspect ratio similar to the aspect ratio of the set paper size may be stored in the program memory 203. In this case, for example, sizes having an aspect ratio similar to the aspect ratio of the L size (postcard, duodecimo size, etc.) are associated with the L size serving as the set paper size in the table, but a size having an aspect ratio greatly different from the aspect ratio of the L size (e.g., western-style envelope No. 6, etc.) is not associated with the L size. When identifying the set paper size, the CPU 201 references this table. For example, in a case that the set paper size is the L size, and the candidates are the duodecimo size and western-style envelope No. 6, the CPU 201 identifies the postcard and duodecimo size associated to the L size in the table. The CPU 201 employs information in which sizes having a similar aspect ratio are associated beforehand, such as this table, whereby a candidate can rapidly identified without performing comparison of aspect ratios each time candidates are narrowed down.

"Set paper size" described in the above embodiment is not restricted to a size that the user has specified at a device configured to transmit a print job. For example, "set paper size" may be a size that the user has set to the printer 100 using the operation panel 218 of the printer 100. Further, "set paper size" is not restricted to a size that the user specifies, and may be a size that is automatically set according to various conditions such as the type of a device which transmits a print job, an application, the print mode at the printer 100, and so forth.

Also, an example has been described in the above embodiment in which when printing based on the print job received from an external device of the printer 100, or the copy function is executed at the printer 100, the CPU 201 identifies the size of the print sheet based on the detection result of the paper sensor 118. However, the above embodiment is not restricted to this, and for example, when printing an image stored in the memory card 223 inserted in the memory card slot 222 in accordance with the print settings that the user has set at the operation panel 218, the CPU 201 may execute the print sheet size identification processing. For example, in a case that the paper size has not been specified in the print setting information indicating the print settings that the user has specified, the CPU 201 may execute the size identification processing. Note that, a case where the paper size has not been specified in the print setting information may be a case where the paper size is not included in the print setting. Alternatively, this case may be a case where an instruction for executing setting processing of the paper size according to the detection result of the paper width by the paper sensor 118 is included in the print setting information.

Also, in a case of performing printing in accordance with the print settings that the user has specified at the printer 100, the CPU 201 may print an image stored in the internal memory which the printer 100 includes instead of the external memory such as the memory card 223. Alternatively, the CPU 201 may print an image stored in an external device such as a server or the like connected to the printer 100 via a network in accordance with the print settings that the user has specified at the operation panel 218 of the printer 100.

Further, though an example has been descried in the above embodiment in which the paper sensor 118 of the printer 100 detects the width of paper, the detected portion is not restricted to this, and a sensor may detect the length of paper, or may detect both of the width and length of paper. Even when employing either of the detection methods, in a case that there are multiple candidates as the size of the print sheet used at the printer 100, the CPU 201 can decide a more suitable paper size by the processing described in the above embodiment.

Also, instead of automatically identifying the size of paper using a sensor, the user may specify the size of paper which the user has inserted into a discharge port of the printer 100 from the operation panel 218 of the printer 100, for example. In this case, the size specified by the user is applied as the paper size automatically identified by the paper sensor 118 in the above embodiment, whereby the CPU 201 executes the processing in the above embodiment.

Note that timing of the user specifying the size of paper such as described above may be optional. For example, a sensor configured to detect opening/closing of the cassette of the printer 100, or a sensor configured to detect whether or not there is paper in the discharge port is provided to the printer 100. Next, in a case of the sensor detecting that the cassette has been opened and closed, or in a case of the sensor detecting that paper is inserted into the discharge port, the CPU 201 displays a screen for allowing the user to specify the size or type of this paper on the operation panel of the printer 100.

Also, an example has been described in the above embodiment in which the CPU 201 which the printer 100 includes executes the processing illustrated in FIG. 6. However, instead of this configuration, a server or the like which transmits the print job received from a host computer, smart device, or client device causing the printer 100 to execute printing may execute the processing in the present embodiment as a print controller.

Specifically, when transmitting a print job to the printer 100, the host computer, server, or smart device execute the processing in S1001 to S1007 in FIG. 5. That is to say, when transmitting a print job to the printer 100, these devices acquire information of the paper width of a print sheet detected by the paper sensor 118 of the printer 100. Next, the host computer, server, or smart device identifies a candidate size of the print sheet according to the paper width that the acquired information indicates, and decides the layout region based on the identified candidate and set paper size. The host computer, server, or smart device rasterize the printing target image on memory which these devices include, transmit the rasterized image to the printer 100 as a print job to execute printing at the printer 100. Specifically, the printing mechanism within the printer 100 prints the image received from the host computer, server, or smart device on the print sheet under the control of the CPU 201 of the printer 100.

Note that, in a case of performing cancellation of printing in S1213 and S1214 in FIG. 6 in the above configuration, the host computer, server, or smart device issues an error. Specifically, the host computer, server, or smart device performs display indicating that printing has been cancelled, or display for allowing the user to confirm both or one of the size of the print sheet set in the printer 100 and the set paper size. In a case of displaying an error at the host computer, the host computer performs display on an external display device connected to the host computer. Alternatively, in a case of displaying an error at the server, the server notifies the contents of error display to a client device which has transmitted a print job to the server, and the client device performs error display on the internal or external display device.

Also, the host computer, server, or smart device may perform up to determination of the size of the layout region in S1208, S1210, and S1211 as another example. In this case, the CPU 201 of the printer 100 executes enlargement/reduction of the printing target image in S1212. In addition, various configurations may be applied to the present embodiment regarding sharing of processing between the printer 100 and a device, such as the host computer, server, or smart device.

Also, though an example has been described in the above embodiment in which a print sheet is employed as an example of a print medium on which an image is printed by the printer 100, the print medium is not restricted to this, and may be an overhead projector (HOP) sheet. Also, the shape of the print medium is not restricted to a rectangular print medium such as a print sheet, and may be a disc-shaped recording medium such as a CD, DVD, or the like. Since such a disc-shaped medium is circular in shape, when the paper sensor 118 performs scanning more than once while performing conveyance of the medium, the width of the medium changes greatly. Accordingly, the shape of the print medium can be determined to be a disc shape.

Therefore, though a disc-like shape is supported as the size of the print setting medium, the size of a medium detected by the paper sensor 118 is not a disc-shaped medium but a rectangular medium for example, control is performed so as not to execute printing by the processing in the present embodiment. On the other hand, in a case that a disc-like shape is supported as the size of the print setting medium, and also the size of the medium detected by the paper sensor 118 is a disc-shaped medium, printing is executed.

Note that the functions of the present embodiment can be realized by the following configuration. Specifically, program code to perform the processing in the present embodiment is supplied to a system or device, and a computer (or CPU or MPU) of the system or device thereof executes the program code, thereby achieving the functions of the present embodiment. In this case, the program code itself read out from the storage medium realizes the functions of the present embodiment, and also the storage medium thereof storing the program code also realizes the functions of the present embodiment.

Other Embodiments

Embodiments of the present invention can also be realized by a computer of a system or apparatus that reads out and executes computer executable instructions recorded on a storage medium (e.g., non-transitory computer-readable storage medium) to perform the functions of one or more of the above-described embodiment(s) of the present invention, and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

Also, the program code for realizing the functions of the present embodiment may be executed by a single computer (CPU or MPU), or may be executed in collaboration with multiple computers. Further, the program code may be executed by a computer, or hardware, such as a circuit for realizing the functions of the program code may be provided. Alternatively, an arrangement may be made in which hardware realizes part of the program code, and a computer realizes the remaining part.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-137055, filed Jun. 28, 2013, which is hereby incorporated by reference herein in its entirety.

What is claimed is:

1. A print control device comprising:

an acquiring unit configured to acquire one or more candidate sizes of a print medium obtained by a sensor detecting a size of the print medium;

a specifying unit configured to specify, in a case that a plurality of candidate sizes having different aspect ratios are acquired by the acquiring unit and a setting size for a print medium set in print target data is not included in the plurality of candidate sizes, a candidate size having an aspect ratio corresponding to an aspect ratio of the setting size, from the plurality of candidate sizes; and a print controller configured to cause a printer to print an image based on the print target data having a size corresponding to the candidate size specified by the specifying unit.

2. The print control device according to claim 1, wherein the print controller causes, in a case that the setting size is included in the one or more candidate sizes acquired by the acquiring unit, the printer to print an image corresponding to the setting size.

3. The print control device according to claim 2, wherein the print controller performs control so as to prevent the print target data from being printed on the print medium in a case that neither the setting size nor a candidate size having an aspect ratio corresponding to the aspect ratio of the setting size are included in the one or more candidate sizes acquired by the acquiring unit.

4. The print control device according to claim 3, further comprising:

a notification unit configured to notify a user of the control being performed in a case that the print controller performs the control so as to prevent the print target data from being printed on the print medium.

5. The print control device according to claim 3, wherein, in a case that neither the setting size nor a candidate size having an aspect ratio corresponding to an aspect ratio of the setting size are included in the one or more candidate sizes acquired by the acquiring unit, the print controller determines whether to print the print target data on the print medium in accordance with a predetermined condition, and in a case that the print controller determines not to print the print target data on the print medium, prevents the print target data from being printing on the print medium.

6. The print control device according to claim 5, wherein the print controller determines whether to print the print target data on the print medium with a print instruction by a user as the predetermined condition.

7. The print control device according to claim 5, wherein the print controller determines whether to print the print target data on the print medium with a type of print medium set as a print setting, as the predetermined condition.

8. The print control device according to claim 1, wherein the print controller causes the printer to print, in a case that a plurality of candidate sizes having aspect ratios corresponding to the aspect ratio of the setting size are specified by the specifying unit, an image having a size based on the specified plurality of candidate sizes, and a margin setting.

9. The print control device according to claim 8, wherein the print controller individually selects a width and a length corresponding to the margin setting from widths and lengths of the plurality of specified candidate sizes respectively, and prints an image having a size based on the selected width and length.

10. The print control device according to claim 8, wherein the margin setting is information for setting whether a margin is provided to a print medium in printing.

11. The print control device according to claim 10, wherein the print controller causes the printer to print, in a case that the margin setting is a setting for not providing a margin to a print medium, an image having a size greater than any of the plurality of specified candidate sizes.

12. The print control device according to claim 1, wherein the print controller causes the printer to convey a print medium to a position corresponding to a printing head, and executes printing on the conveyed print medium using the printing head;

and wherein the sensor is provided to a position corresponding to the printing head, and when a print medium is conveyed, the sensor detects the size of the conveyed print medium.

13. The print control device according to claim 1, wherein the sensor detects a width of a print medium, and the acquiring unit acquires, based on the detected width of the print medium, one or more candidate sizes of the print medium.

14. The print control device according to claim 1, wherein the setting size is a size set in the print target data by a user.

15. The print control device according to claim 1, wherein the print controller changes a size of an image based on the print target data in accordance with the candidate size specified by the specifying unit, and causes the printer to print the image of which the size is changed.

16. A print control method comprising:

acquiring one or more candidate sizes of a print medium obtained by a sensor detecting a size of the print medium;

specifying, in a case that a plurality of candidate sizes having different aspect ratios are acquired in the acquiring step and a setting size for a print medium set in print target data is not included in the plurality of candidate sizes, a candidate size having an aspect ratio corresponding to an aspect ratio of the setting size, from the plurality of candidate sizes; and causing a printer to print an image based on the print target data having a size corresponding to the candidate size specified by the specifying step.

17. A computer readable storage medium storing computer executable instructions for causing a computer to execute the print control method, the method comprising:

acquiring one or more candidate sizes of a print medium obtained by a sensor detecting a size of the print medium;

specifying, in a case that a plurality of candidate sizes having different aspect ratios are acquired in the acquiring step and a setting size for a print medium set in print target data is not included in the plurality of candidate sizes, a candidate size having an aspect ratio corresponding to an aspect ratio of the setting size, from the plurality of candidate sizes; and causing a printer to print an image based on the print target data having a size corresponding to the candidate size specified by the specifying step.

* * * * *